US011371814B2

(12) United States Patent
Harris et al.

(10) Patent No.: US 11,371,814 B2
(45) Date of Patent: Jun. 28, 2022

(54) GROUND-PROJECTILE GUIDANCE SYSTEM

(71) Applicant: Leigh Aerosystems Corporation, Carlsbad, CA (US)

(72) Inventors: Gordon L. Harris, Carlsbad, CA (US); Stephen L. Harris, Carlsbad, CA (US)

(73) Assignee: Leigh Aerosystems Corporation, Carlsbad, CA (US)

( * ) Notice: Subject to any disclaimer, the term of this patent is extended or adjusted under 35 U.S.C. 154(b) by 0 days.

(21) Appl. No.: 15/244,431

(22) Filed: Aug. 23, 2016

(65) Prior Publication Data

US 2017/0191809 A1 Jul. 6, 2017

Related U.S. Application Data

(60) Provisional application No. 62/209,253, filed on Aug. 24, 2015.

(51) Int. Cl.

| | |
|---|---|
| ***F42B 10/14*** | (2006.01) |
| ***F42B 30/10*** | (2006.01) |
| ***F41G 7/22*** | (2006.01) |
| ***F42B 10/64*** | (2006.01) |
| ***F41G 7/34*** | (2006.01) |
| ***F42B 10/38*** | (2006.01) |
| ***F42B 10/46*** | (2006.01) |

(52) U.S. Cl.

CPC ..... *F42B 10/14* (2013.01); *F41G 7/22* (2013.01); *F41G 7/346* (2013.01); *F42B 10/38* (2013.01); *F42B 10/46* (2013.01); *F42B 10/64* (2013.01); *F42B 30/10* (2013.01)

(58) Field of Classification Search

CPC ..... F42B 10/14; F42B 10/34; F42B 15/01

See application file for complete search history.

(56) References Cited

U.S. PATENT DOCUMENTS

| | | | | |
|---|---|---|---|---|
| 3,265,329 | A | 8/1966 | Postelson | |
| 3,556,239 | A | 1/1971 | Spahn | |
| 3,868,883 | A * | 3/1975 | Tucker | F41G 7/305 244/3.12 |
| 3,876,925 | A | 4/1975 | Stoeckert | |
| 4,163,904 | A | 8/1979 | Skendrovic | |
| 4,168,759 | A | 9/1979 | Hull et al. | |

(Continued)

FOREIGN PATENT DOCUMENTS

| | | |
|---|---|---|
| DE | 4335785 A1 | 4/1995 |
| EP | 0506536 B1 | 5/1995 |

(Continued)

*Primary Examiner* — Philip J Bonzell
*Assistant Examiner* — Tye William Abell
(74) *Attorney, Agent, or Firm* — Mintz Levin Cohn Ferris Glovsky and Popeo, P.C.

(57) ABSTRACT

A range extension unit extends the range of a guided mortar bomb. The range extension unit includes a housing interface defining an internal cup that receives a rear portion of a guided mortar bomb, wherein the housing interface covers a rear portion of the mortar bomb. The housing interface, when coupled to the mortar bomb, collectively forms an aerodynamically shaped body with the mortar bomb. At least two deployable wings are attached to the housing interface, wherein the wings transition between a retracted state and a deployed state.

10 Claims, 12 Drawing Sheets

(56) References Cited

U.S. PATENT DOCUMENTS 4,334,657 A * 6/1982 Mattson ..... F42B 30/10 102/473
4,373,688 A 2/1983 Topliffe
4,423,368 A 12/1983 Bussiere
4,424,042 A 1/1984 Gongwer
4,434,718 A * 3/1984 Kopsch ..... F42B 14/064 102/439
4,438,893 A 3/1984 Sands et al.
4,477,040 A 10/1984 Karanik
4,512,537 A 4/1985 Sebestyen et al.
4,561,611 A * 12/1985 Sinclair ..... F41G 7/222 244/3.16
4,565,340 A * 1/1986 Bains ..... F42B 10/14 244/3.1
4,568,039 A 2/1986 Smith et al.
4,587,803 A 5/1986 Nightingale et al.
4,917,332 A 4/1990 Patterson, Jr.
4,923,143 A 5/1990 Steuer et al.
5,141,173 A 8/1992 Lay
5,150,859 A 9/1992 Ransick
5,186,420 A 2/1993 Beauchamp et al.
5,235,930 A 8/1993 Pendleton
5,238,204 A * 8/1993 Metz ..... F42B 10/661 244/3.15
5,297,764 A 3/1994 Haney
5,386,146 A 1/1995 Hickey
5,393,011 A 2/1995 Dunn et al.
5,452,864 A * 9/1995 Alford ..... F42B 10/26 244/3.23
5,490,572 A 2/1996 Tajiri et al.
5,505,587 A 4/1996 Ghetzler
5,680,032 A 10/1997 Pena
5,934,612 A 8/1999 Gerhardt
6,138,781 A 10/2000 Hakala
6,237,496 B1 * 5/2001 Abbott ..... F42B 10/64 102/384
6,270,309 B1 8/2001 Ghetzler et al.
6,373,145 B1 4/2002 Hamrick
6,695,252 B1 * 2/2004 Dryer ..... F42B 10/14 244/3.28
6,700,215 B2 3/2004 Wu
6,838,782 B2 1/2005 Vu
6,857,492 B1 2/2005 Liskey et al.
6,897,575 B1 5/2005 Yu
7,354,017 B2 * 4/2008 Morris ..... F42B 10/54 244/3.23
7,412,930 B2 8/2008 Smith et al.
7,475,846 B2 1/2009 Schroeder
7,497,287 B2 3/2009 Kunikata et al.
7,665,554 B1 2/2010 Walsh
7,752,976 B2 * 7/2010 Banks ..... F42B 12/06 102/489
7,789,182 B2 9/2010 Bradley et al.
7,923,671 B1 4/2011 Huguenin et al.
7,963,442 B2 6/2011 Jenkins et al.
7,982,328 B2 7/2011 Huntemann
8,026,465 B1 9/2011 Fraysse, Jr.
8,113,118 B2 2/2012 Schmidt et al.
8,220,392 B1 * 7/2012 Maldonado ..... F42B 5/08 102/351
8,237,096 B1 * 8/2012 Alexander ..... F42B 10/64 244/3.25
8,324,544 B2 12/2012 Palani et al.
8,426,788 B2 4/2013 Geswender
8,434,574 B1 5/2013 York et al.
8,509,992 B1 8/2013 Bosworth
8,640,589 B2 * 2/2014 Dryer ..... F42B 10/16 86/51
8,653,688 B2 2/2014 Justak et al.
8,674,277 B2 * 3/2014 Axford ..... F42B 10/12 102/501
8,678,310 B2 3/2014 Masoudipour et al.
8,686,330 B2 * 4/2014 Johansson ..... F42B 10/38 244/3.28
8,710,691 B2 4/2014 Haddad
8,790,068 B2 7/2014 Cantwell
8,791,588 B2 7/2014 Steinlechner
8,814,081 B2 8/2014 Gagne et al.
8,911,703 B2 12/2014 McAlister
8,967,302 B2 3/2015 Tran
9,021,961 B1 * 5/2015 Manole ..... F42B 10/44 102/439
9,285,196 B2 * 3/2016 Harris ..... F42B 10/64
9,371,739 B2 6/2016 Robinson et al.
9,546,854 B2 1/2017 Harris et al.
9,670,899 B2 6/2017 Steinlechner
9,745,960 B2 8/2017 Dietzel
9,828,110 B2 11/2017 Rogues
9,957,060 B2 5/2018 Riordan
2001/0039898 A1 11/2001 Bar et al.
2002/0066608 A1 6/2002 Guenard et al.
2002/0153178 A1 10/2002 Limonius
2003/0209370 A1 11/2003 Maberry
2004/0084908 A1 5/2004 Vu
2005/0029027 A1 2/2005 Kunikata et al.
2005/0098361 A1 5/2005 Mitchell
2005/0151000 A1 7/2005 Dodu et al.
2006/0113118 A1 6/2006 Kim
2007/0089918 A1 4/2007 Gonzalez
2007/0284155 A1 12/2007 Cong
2008/0001023 A1 * 1/2008 Schroeder ..... F42B 10/14 244/3.24
2008/0006736 A1 1/2008 Banks
2008/0169133 A1 7/2008 Tomoyasu
2008/0223977 A1 * 9/2008 Dryer ..... F42B 10/14 244/3.22
2008/0308671 A1 12/2008 Harnoy
2008/0315032 A1 12/2008 Harnoy
2009/0026770 A1 1/2009 Huntemann
2009/0114763 A1 5/2009 Geck et al.
2009/0133943 A1 5/2009 Noguchi et al.
2010/0147992 A1 6/2010 Mock
2010/0275805 A1 11/2010 Rastegar et al.
2010/0282895 A1 11/2010 Geswender
2011/0033280 A1 2/2011 Justak
2011/0073705 A1 3/2011 Huguenin et al.
2011/0100731 A1 5/2011 Hassan
2011/0101698 A1 5/2011 Saluccio
2011/0180655 A1 7/2011 Deschatre
2011/0285886 A1 11/2011 Kato et al.
2011/0297783 A1 * 12/2011 Martinez ..... F42B 10/14 244/3.21
2012/0006938 A1 1/2012 Gatzke
2012/0048991 A1 3/2012 Frey, Jr.
2012/0160957 A1 6/2012 Gagne et al.
2012/0217338 A1 8/2012 Flood et al.
2012/0248239 A1 * 10/2012 Geswender ..... F42B 10/26 244/3.23
2012/0299558 A1 11/2012 Justak et al.
2012/0301273 A1 11/2012 Justak
2013/0048780 A1 2/2013 Masoudipour et al.
2013/0158828 A1 6/2013 McAlister
2013/0248657 A1 9/2013 Riordan
2014/0002756 A1 1/2014 Huang et al.
2014/0027563 A1 1/2014 Harris et al.
2014/0193236 A1 7/2014 Robinson et al.
2014/0312162 A1 10/2014 Geswender et al.
2015/0128636 A1 5/2015 McAlister
2017/0101884 A1 4/2017 Harris et al.
2017/0219324 A1 8/2017 Harris et al.

FOREIGN PATENT DOCUMENTS

EP 1 092 941 B1 8/2005
RU 2172462 C2 8/2001
WO WO-2008/010226 A1 1/2008
WO WO-2010/016967 A1 2/2010
WO WO-2010/039322 A2 4/2010

* cited by examiner

GROUND-PROJECTILE GUIDANCE SYSTEM

REFERENCE TO PRIORITY DOCUMENT

This application claims priority to U.S. Patent Provisional Application Ser. No. 62/209,253 entitled "Ground-Projectile Guidance System" and filed on Aug. 24, 2015. Priority to the aforementioned filing date is claimed and the provisional patent application is incorporated herein by reference in its entirety.

BACKGROUND

The present disclosure relates to unguided, ground-launched projectiles and in particular to a system for accurately guiding ground projectiles such as Guided Mortar Bombs (GMBs) and artillery shells. Many entities manufacture such unguided projectiles in various sizes and forms. Armed forces around the world maintain large inventories of these munitions.

By their nature, unguided projectiles are "dumb" in that they are not accurately guided to a target. As a result, successful use of such projectiles is largely dependent on the particular skill and experience level of the person launching the projectile. To overcome these limitations, various schemes for providing automatic guidance to these devices have been developed, including the guidance unit that is the subject of U.S. Pat. No. 9,285,196 (issued Mar. 15, 2016) entitled "Ground-Projectile Guidance System", which is incorporated herein by reference in its entirety. Once systems as these can accurately guide the munitions to the target, the opportunity arises to enable the munition to achieve greater ranges. The unique range extension unit described in the following accomplishes this.

SUMMARY

Disclosed is a device configured to extend the range of a projectile such as, for example, a standard Guided Mortar Bomb (GMB). The device can be used to increase the effective range of a projectile and also to improve the accuracy of the projectile against targets at short range. The disclosed system includes a range extension unit, which is a device that can be attached to a standard GMB. When attached, the range extension unit adds aerodynamic lift to the GMB to extend/increase the range of the GMB in comparison to the GMB without the range extension unit being equipped. The range extension unit includes a set of wings that can be transitioned between a retracted state and a deployed state. When attached to the GMB, the range extension unit provides the entire structure with a center of gravity that is relatively closely positioned to an aerodynamic center of the wing.

In one aspect, there is disclosed a range extension unit for a guided mortar bomb, comprising: a housing interface defining an internal cup that receives a rear portion of a guided mortar bomb, the housing interface covering a rear portion of the mortar bomb in the area between a start of an aft-sloping part of the mortar bomb and a root of a propulsion charge stem attachment point at the rear of the mortar bomb, such that the housing interface, when coupled to the mortar bomb, collectively form an aerodynamically shaped body with the mortar bomb; and at least two deployable wings attached to the housing interface, wherein the wings transition between a retracted state and a deployed state.

In another aspect, there is disclosed a method of extending a range of a mortar bomb, comprising: providing a mortar bomb; inserting a rear region of a mortar bomb into a housing interface of a range extension unit, the housing interface defining an internal cup that receives a rear portion of a guided mortar bomb, and such that the housing interface covers a rear portion of the mortar bomb in the area between a start of an aft-sloping part of the mortar bomb and a root of a propulsion charge stem attachment point at the rear of the mortar bomb, and such that the housing interface, when coupled to the mortar bomb, collectively forms an aerodynamically shaped body with the mortar bomb, wherein the range extension unit includes at least two deployable wings attached to the housing interface.

The details of one or more variations of the subject matter described herein are set forth in the accompanying drawings and the description below. Other features and advantages of the subject matter described herein will be apparent from the description and drawings, and from the claims.

DETAILED DESCRIPTION

Disclosed herein is a device configured to extend the range of a projectile such as, for example, a standard Guided Mortar Bomb (GMB). The device can be used to increase the effective range of a projectile and also to improve the accuracy of the projectile against targets at short range. The disclosed system includes a range extension unit, which is a device that can be attached to a standard GMB. When attached, the range extension unit adds aerodynamic lift to the GMB to extend/increase the range of the GMB in comparison to the GMB without the range extension unit being equipped. The range extension unit includes a set of wings that can be transitioned between a retracted state and a deployed state. When attached to the GMB, the range extension unit provides the entire structure with a center of gravity that is relatively closely positioned to an aerodynamic center of the wing.

Figure 1:
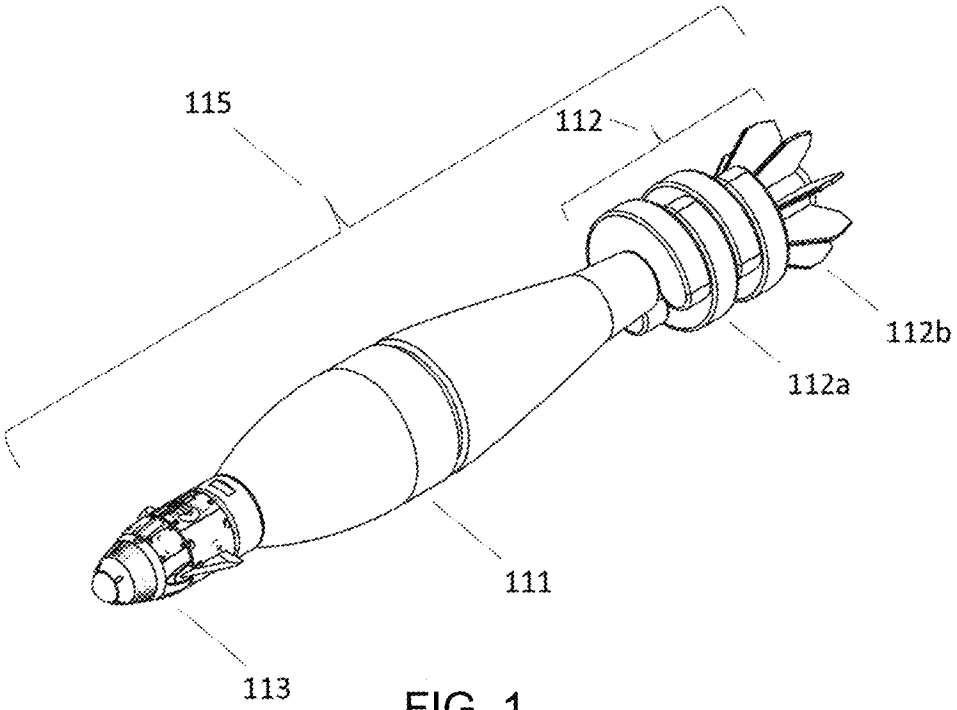
FIG. 1 shows a Guided Mortar Bomb (GMB) or munition without a Range Extension Unit (REU).

FIG. 1 shows a Guided Mortar Bomb (115) that includes a stock mortar bomb body (111) with stock tail section (112) at one end of the mortar bomb body (111). The stock mortar bomb body (111) is an elongated structure having an aerodynamic shape. For example, the body (111) can have a tapered front section that increases in diameter toward a maximum diameter middle section and then gradually decreases in diameter to form a decreasing slope moving toward the tail section (112), particularly a propulsion charge stem attached to the body (111) at an attachment point at the rear of the body. The mortar bomb thus has a maximum cross-section dimension that, moving rearward, starts an aft-sloping part that slopes toward a root of a propulsion charge stem attachment point at the rear end of the body (111). The REU, when attached to the bomb body, is positioned on or over the aft-sloping part that slopes toward the root of the propulsion charge stem attachment point. The REU and GMB collectively form an aerodynamically shaped body when attached to one another.

Note that the body does not have any wing or fin structures forward of the tail section (112). The stock tail section (112) includes a propulsion charge stem that extends in a rearward direction from the stock mortar bomb body (111) to mount a propulsion charge (112*a*) and stabilizing fin set (112*b*) that includes a plurality of fins fixedly mounted to the structure. The propulsion charge stem extends from an attachment point at the rear of the GMB.

A nose-mounted guidance unit (113) is mounted on a front region of the GMB. An example of a nose-mounted guidance unit (113) is described in detail below.

Figure 2:
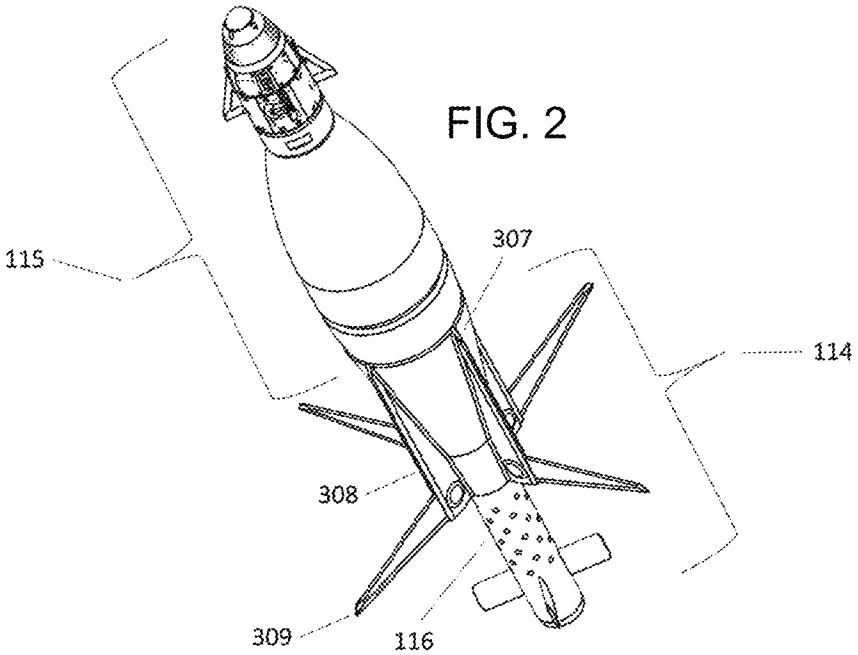
FIG. 2 shows a perspective view of a guided munition having the subject REU attached to the munition.

FIG. 2 shows a perspective view of a range extension unit (REU) (114) coupled to a GMB (115). The REU (114) is a structure that fits on to the GMB (such as on a rear portion of the GMB) to provide the GMB with a set of wings that are positioned on the GMB at a location that is otherwise unused without the presence of the REU. The REU 114 includes a conical housing (307) (described below) supporting two or more fasteners, such as clevises (308), that house and protect two or more extendable wings (309) and which are attached to the GMB body. The wings (309) are movably attached to the structure, such that the wings can move between a retracted position and an extended position with the extended position shown in FIG. 2.

The GMB body can vary somewhat with the particular make of GMB. When coupled to the GMB (115), the REU (114) and GMB (115) collectively form an aerodynamically shaped body. The stem (116) in this example is an elongated, cylindrical structure that extends rearwardly from the GMB body. The stem (116) can be modified to provide minimum aerodynamic effect, but may also be removably ejected entirely upon exiting the muzzle of a firing device as the stem does not necessarily contribute appreciably to stability or lift of the device.

Figures 3A, 3B:
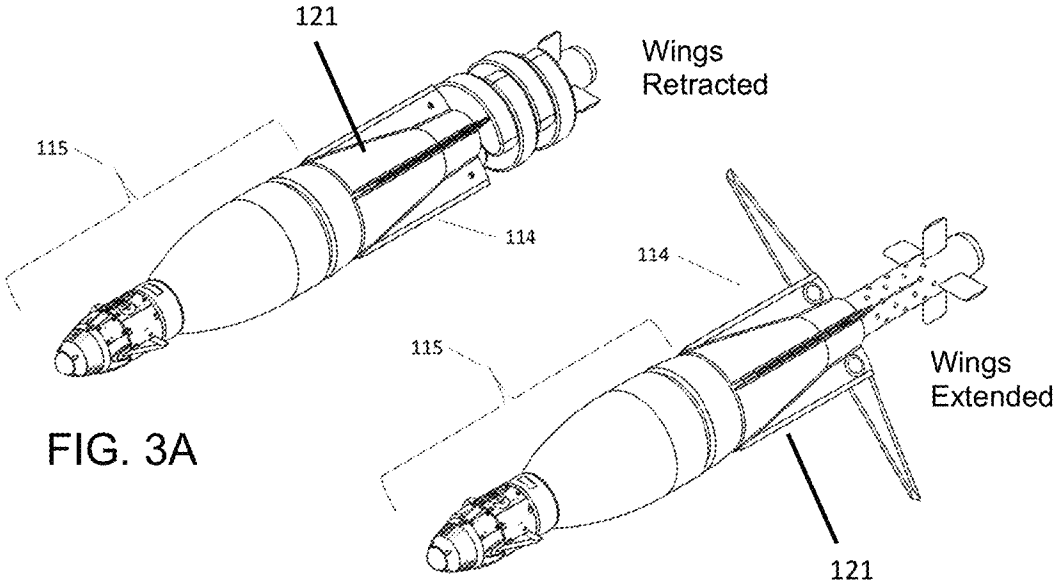
FIGS. 3A and 3B shows the REU attached to the projectile with wings in a retracted configuration and an extended configuration, respectively.

FIGS. 3A and 3B shows the REU (114) attached to the GMB (115). As mentioned, the REU (114) transitions between a first, pre-fire configuration wherein the set of wings is stowed or otherwise nested against the body of the REU, and as second, post-fire or flight configuration in which the set of wings are extended or deployed such that they are positioned outwardly relative to the body of the REU. FIG. 3B shows the wings in the extended or deployed state such that the wings are positioned to provide lift to the body when in movement.

Figure 4:
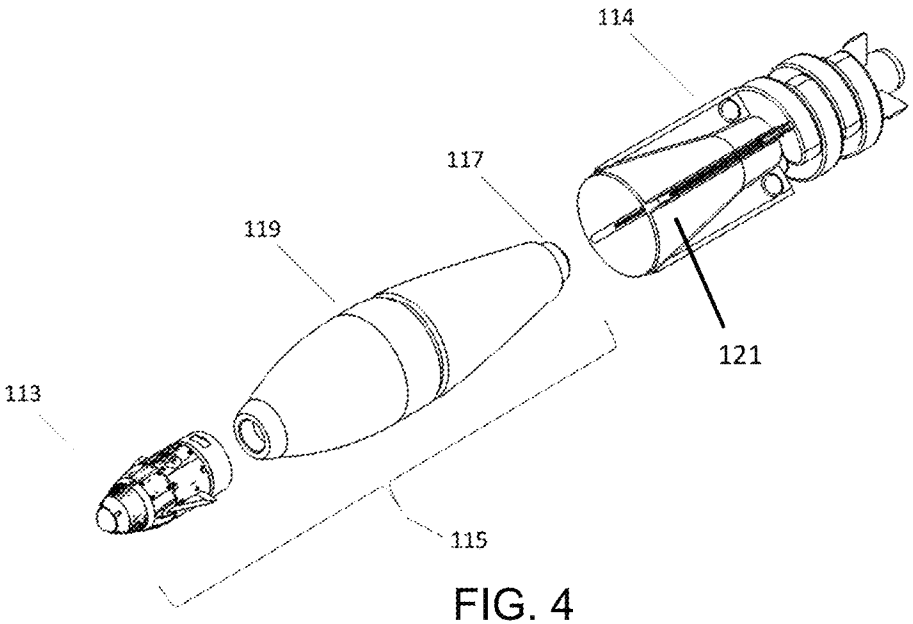
FIG. 4 shows an example mechanism of attachment of a guidance kit and REU to a munition with a standard tail interface.

FIG. 4 shows the device in an exploded state and illustrates how the guidance unit (113) and the REU (114) attaches to a munition (119) to convert the munition (119) into a GMB (115). The munition (119) is a passive, aerodynamic body. As shown, the REU (114) includes an interface, such as a cup shaped interface member (121) that includes or defines an internal cavity or seat into which a rear portion of the GMB (115) can be inserted. The internal seat of the interface (121) has a shape that complements the outer shape of the rear portion of the munition (119) so that the munition (119) can flit flush into the interface (121). In this manner, the REU (114) attaches to a rear portion of the GMB (115) to convert the device into an extended range precision-guided projectile (ERGMB), as described in detail below. In the illustrated embodiment, the interface member (121) fixedly attaches to a mounting structure or coupling region (117) at the rear of the munition (119). The coupling region (117) can be coupled, attached, or otherwise secured to the REU (114) in any of a variety of manners. In an example embodiment, the coupling region (117) has outer threads such that it can be threaded into a complementary threaded region of the interface member (121) of the REU (114). It should be appreciated, however, that other manners of coupling the guidance unit (113) to the munition (119) are within the scope of this disclosure.

With reference again to FIG. 2, two or more or more wings (309) are housed within the clevises (308) attached to the conical structure (307) of the REU (114). The wings are mechanized to be automatically spring-deployed in response to the initial setback shock load produced by the mortar gun propellant charge (gun-launch) or by lanyard or other first motion means (air-launch). The wings (309) are configured to provide aerodynamic lift when trimmed at an angle of attack set by the GMB's (115) control system, thereby increasing the REGMB's lift-to-drag ratio, which intern increases range capability.

Figure 5A:
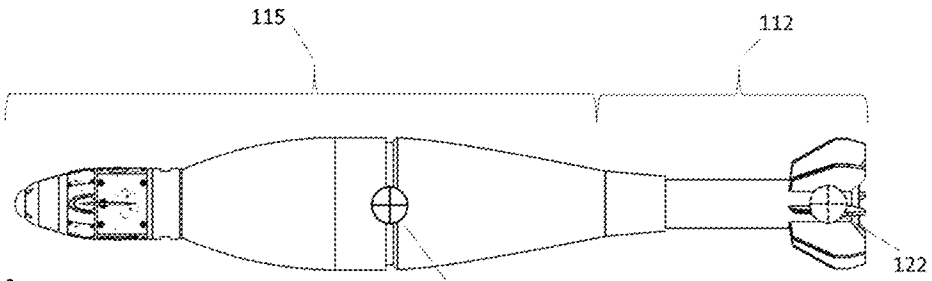
FIG. 5A shows a side-view drawing of the GMB equipped with a stock mortar tail REU.
Figure 5B:
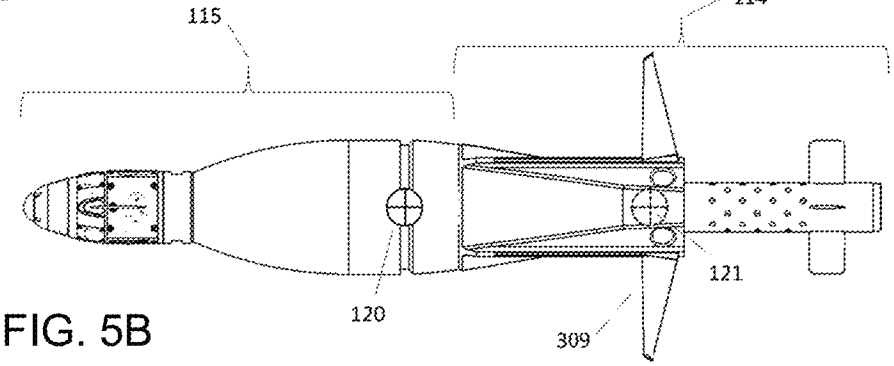
FIG. 5B shows a side view drawing of the GMB equipped with the REU of this disclosure.

FIGS. 5A and 5B show side views of the devices and show the relative positions of the aerodynamic center of lift of the rear lifting surfaces relative to the center of gravity (120) of the entire airframe for both the GMB (115) equipped with stock tailfins (112) with tail surface aerodynamic center (122) (as shown in FIG. 3A) and the GMB (115) equipped with an REU (114) and wing center of lift (121) (as shown in FIG. 3B). Unlike other, conventional approaches (e.g., extending tailfins) the REU's (114) aerodynamic center of lift (121) is located relatively close to the center of gravity (120) of the munition (119).

The relatively close location of the REU wings (309) to the center of gravity (120) allows the REU wings (309) to generate required lift without excessive (negative) pitching moment so as to allow the guidance unit's aerodynamic surfaces to generate sufficient net (positive) pitching moment to sustain angles of attack necessary to achieve extended range. Yet, owing to the size of the high aspect ratio wings, adequate pitch and directional stability is achieved without the need for tailfins.

This is in contrast with other approaches such as extending tailfins located at the stock tailfin position which are intended to provide additional lift for range extension but owing to their far-aft location produce negative pitching moments of such a magnitude to suppress the ability of the control unit to trim the projectile at a desired angle of attack to achieve range extension.

FIGS. 6A-6D depict an example, non-limiting mechanism to deploy the wings upon first motion following detonation of the mortar propellant charge. The root of each wing is mounted on a shaft (123) attached across the vertical walls of the clevis (308) and is powered by a spiral spring (124) and retained by a lead pin (125) which is aligned in an axial (launch) direction. Upon charge detonation of the firing device, the lead pin (125) experiences a load (e.g., several thousand times the force of gravity) under which load it self-extracts from its bore, releasing the wing (308) to move to the extended state. Once released during launch initiation, the tips of the wings slide along a gun bore, at which time the combination of spring force and aerodynamic drag of the forward-deploying wings, extends the wings to full open, extended positions immediately as the projectile exits the firing device, such as a gun. This is a non-limiting example of how this deployment may be mechanized for mortar gun applications. It should be appreciated, however, that other methods of wing deployment are within the scope of this disclosure and may also be used in air-drop variants of this system.

In use, the REU (114) is attached to the GMB (115) by inserting the rear region of the GMB into the interface member (121) of the REU. In this manner, the GMB and REU collectively form an aerodynamically shaped body. As mentioned, when the REU is mounted on the GMB, the REU provides deployable wings along a location of the GMB that would otherwise be unused (i.e., that location would not have wings). In addition, the stem of the GMB extends rearwardly and is positioned rearwardly from the wing such as that the rearmost location of the GMB. The REU can be secured to the GMB such as by mating threads on the GMB with corresponding threads within the interface member of the REU.

Figure 8:
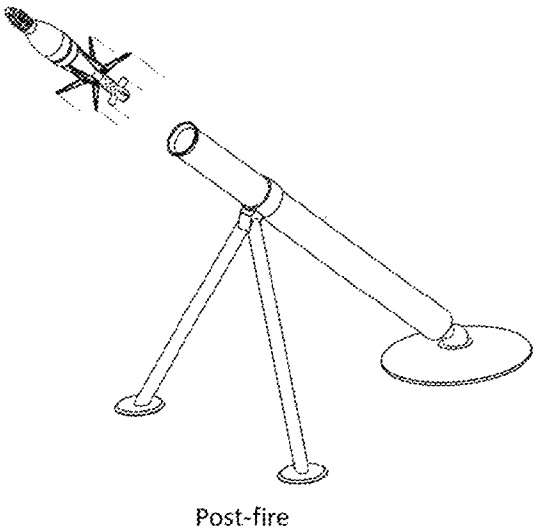
FIG. 8 shows the REU at muzzle exit from the mortar gun during or after firing.
Figure 7:
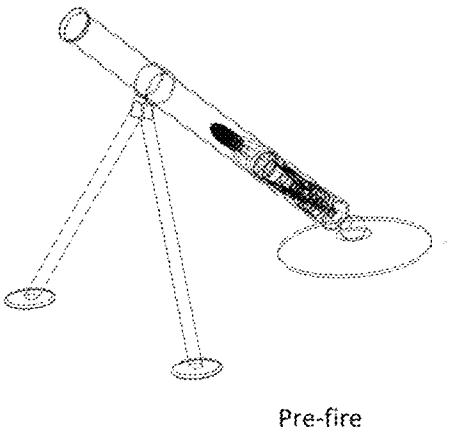
FIG. 7 shows the REU residing in a mortar gun prior to firing.

The GMB projectile with REU (114) unit is launched from a standard mortar tube as depicted in FIG. 7 and FIG. 8, or from an airborne platform such as an airborne platform having 5 in launch tubes or a UAV. FIG. 7 shows the projectile with REU (114) inside the mortar tube prior to launch, while FIG. 8 shows the projectile with REU (114) as it being propelled from the mortar tube. The guidance unit controls its trajectory to the target according to guidance laws that assure optimum use of the available energy imparted at launch to reach maximum range and achieve steep-angle target engagement. It may employ roll to turn or some other form of guidance algorithm to steer the REGMB to the target and to control the orientation of the unit relative to earth to optimize trajectory shaping.

Figure 9:
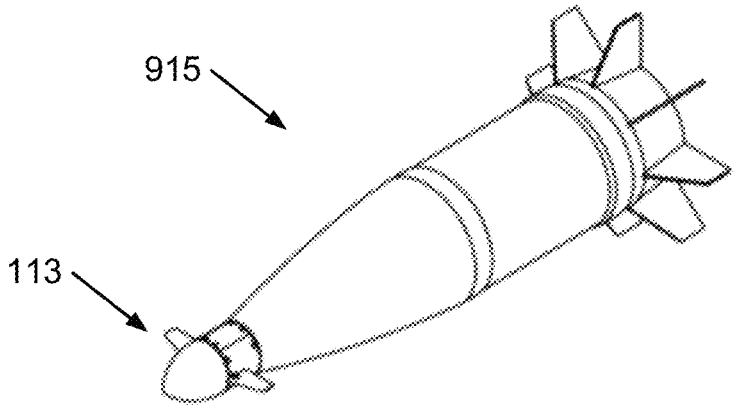
FIG. 9 shows a perspective view of a guidance unit that couples to a projectile.
Figure 10:
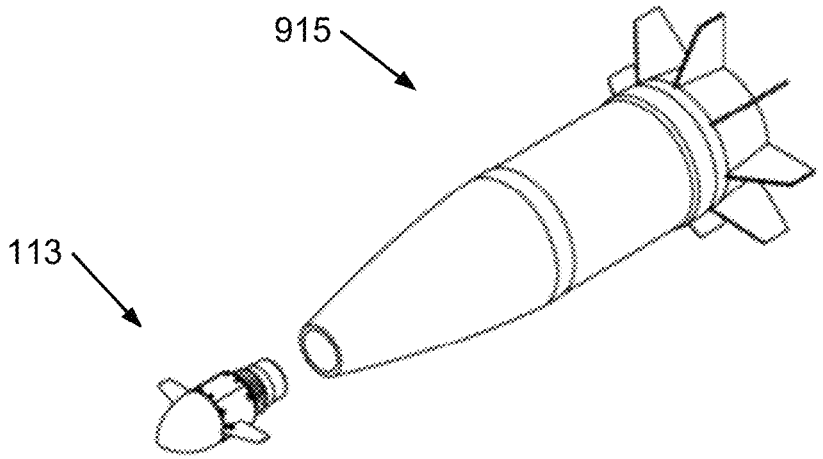
FIG. 10 shows the guidance unit uncoupled from the projectile.

FIG. 9 shows a perspective view of a nose-mounted guidance unit 113 coupled to a ground-launched projectile 915. FIG. 10 shows the guidance unit 113 uncoupled from the projectile 915. The projectile 915 is an unguided projectile in that the projectile itself does not include any components for guiding the projectile 915 to a target. As shown in FIG. 10, the guidance unit 113 attaches to the projectile 915 to convert the projectile 915 into a precision-guided projectile, as described in detail below. In the illustrated embodiment, the guidance unit 113 couples to a front-most end of the projectile 915. In this regard, the guidance unit 113 has an outer housing that forms a bullet-nosed tip such that, when coupled to the projectile 915, the guidance unit 113 and projectile 915 collectively form an aerodynamically shaped body. It should be appreciated that the shape of the projectile and of the guidance unit can vary from what is shown in the figures.

The guidance unit 113 may be equipped with a computer readable memory that is loaded with one or more software applications for controlling the guidance of the projectile 915. Moreover, the guidance unit 113 may be equipped with any of a variety of electro-mechanical components for effecting guidance and operation of the projectile. The components for effecting guidance can vary and can include, for example, a global positioning system (GPS), laser guidance system, image tracking, etc. The guidance unit 113 may also include an guidance-integrated fuse system for arming and fusing an explosive coupled to the projectile 915.

The configuration of the projectile 915 may vary. For example, the projectile 915 may be a tail-fin-stabilized projectile (TSP), such as a mortar bomb or artillery shell. Such an embodiment of a projectile includes one or more fins fixedly attached to the tail of the projectile. In another example, the projectile 915 is a spin-stabilized projectile (SSP). It should be appreciated that the projectile 915 may vary in type and configuration.

Figure 11:
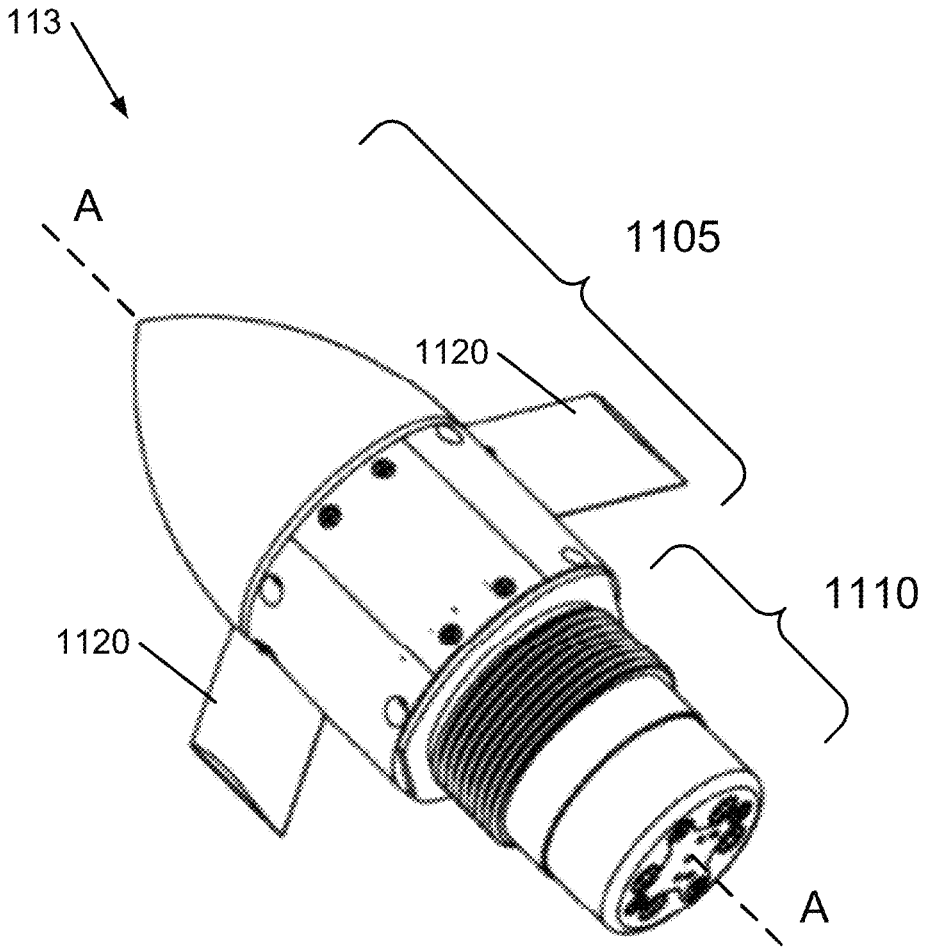
FIG. 11 shows an enlarged view of the guidance unit.

FIG. 11 shows an enlarged view of the guidance unit 113. As mentioned, the guidance unit 113 includes a front housing 1105 that forms a bullet-nosed tip although the shape may vary. A coupling region 1110 is positioned at a rear region of the guidance unit 113. The coupling region 1110 can be coupled, attached, or otherwise secured to the projectile 915 (FIGS. 1 and 2) such as at a front region of the projectile. The front housing 1105 and its contents are rotatably mounted to the coupling region 1110 such that the housing 1105 (and its contents) can rotate about an axis, such as an axis perpendicular to the longitudinal axis A relative to the coupling region 1110, as described in detail below. Rotation about other axes, such as about the axis A, are also possible. The longitudinal axis extends through the center of the unit 113. In the illustrated embodiment, the coupling region 1110 has outer threads such that the coupling region can be threaded into a complementary threaded region of the projectile 915. It should be appreciated, however, that other manners of coupling the guidance unit 113 to the projectile 915 are within the scope of this disclosure.

Figure 12:
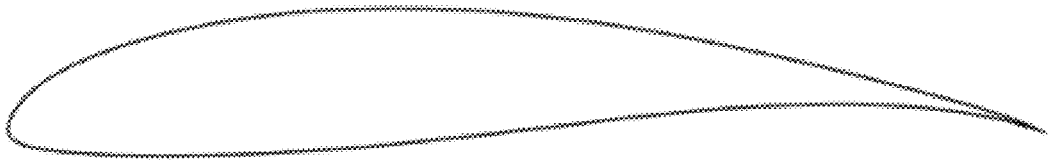
FIG. 12 shows an airfoil shape of a cambered canard.
Figure 13:
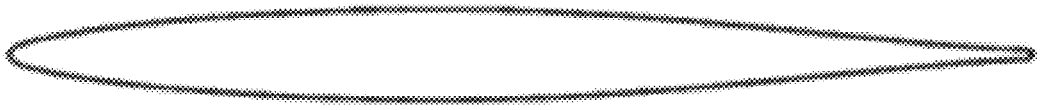
FIG. 13 shows an airfoil shape of a symmetric canard.

With reference still to FIG. 11, two or more control surfaces, such as canards 1120, are positioned on the front housing 1105 of the guidance unit 113. The canards are configured to be proportionally actuated for accurate guidance of the projectile 915 during use, as described in more detail below. That is, an internal motor in the housing 1105 is configured to move the canards in a controlled manner to provide control over a trajectory of the projectile 915. The canards 1120 are configured to aerodynamically control the roll and pitch orientation of the projectile 915 with respect to an earth reference frame. In this regard, the canards can be cambered as shown in FIG. 12 or the canards can be symmetric as shown in FIG. 13. The cambered airfoil can be used for mortar bombs and tail-fin-stabilized artillery shells, while for symmetric airfoil can be used for spin-stabilized projectiles. Any of a variety of airfoil configurations are within the scope of this disclosure.

The guidance unit 113 is configured to achieve proportional actuation in a manner that makes the guidance unit 113 capable of surviving the extremely high loads associated with a gun-launched projectile. In this regard, a motor is mounted inside the front housing within a bearing that is rigidly attached to the housing, as described below. The bearing effectively provides an inertial shield over the motor such that the motor is free to rotate relative to the mortar body about the longitudinal axis A. This configuration advantageously reduces or eliminates inertial loads that are experienced during launch and/or flight from being transferred to the motor. Without such an inertial shield, the motor can experience loads during launch that have been shown to increase the likelihood of damage or destruction of the motor.

Figure 14A:
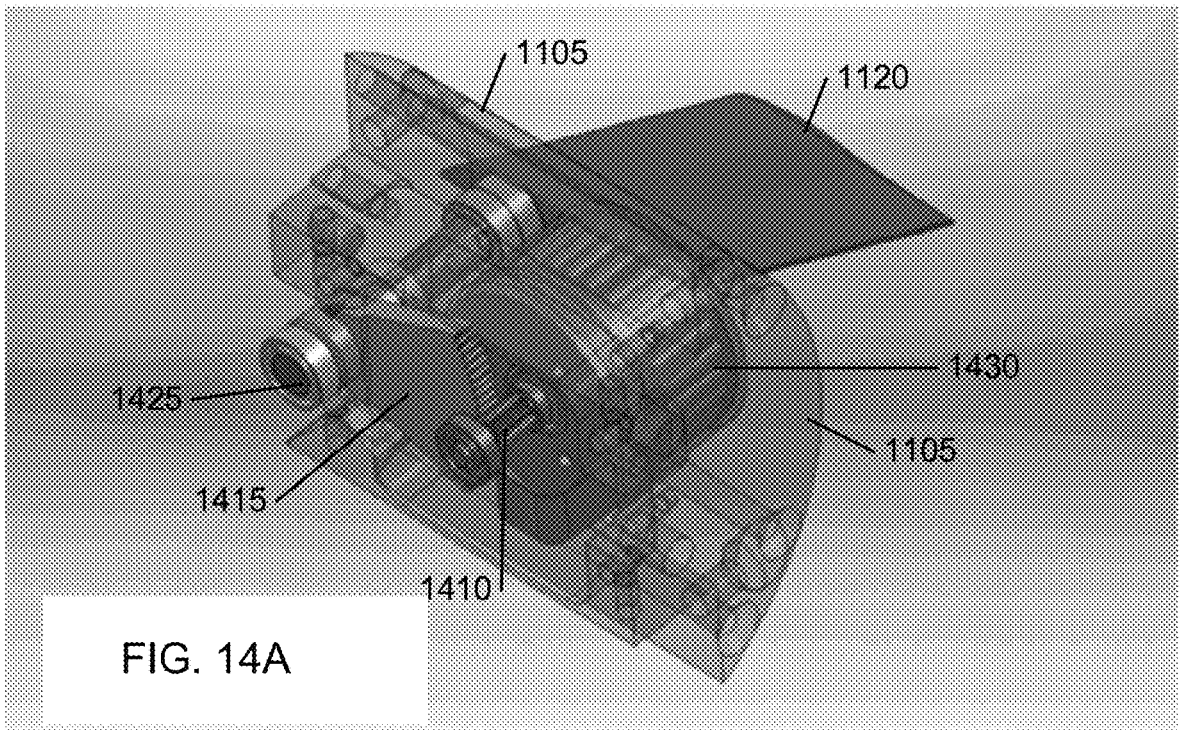
FIGS. 14A and 14B shows a perspective view of a portion of the front housing in partial cross-section.
Figure 14B:
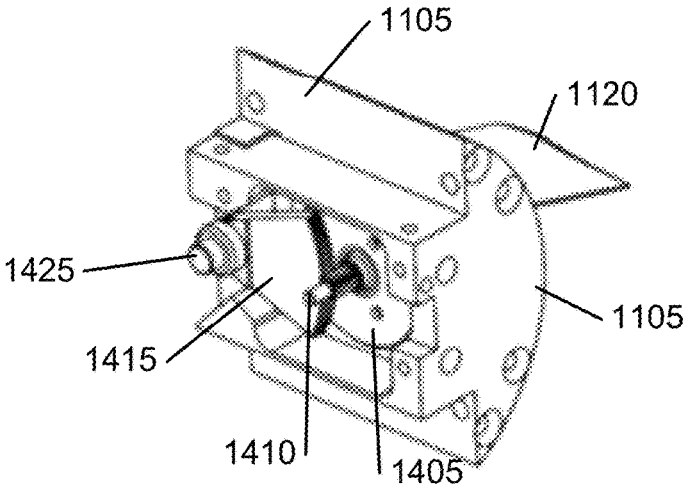

FIG. 14A shows a perspective view of a portion of the front housing 1105 of the guidance unit 113. FIG. 14A shows the guidance unit 113 in partial cross-section with a portion of the device shown in phantom for clarity of reference. FIG. 14B shows the guidance unit in partial cross-section. As discussed above, the canards 1120 are mounted on the outer housing 1105. A motor 605 is positioned inside the housing 1105 within a bearing 1430, which shields the motor 605 from inertial loads during launch, as described below. In the illustrated embodiment, the motor 605 is a flat motor although the type of motor may vary. The motor 605 drives a drive shaft 1410 by causing the drive shaft 1410 to rotate.

The motor 605 is mechanically coupled to the canards 1120 via the drive shaft 1410 and a geared plate 1415. The plate 1415 is mechanically coupled to the drive shaft 1410 via a geared teeth arrangement. In this manner, the plate 1415 translates rotational movement of the drive shaft 1410 to corresponding rotational movement of a shaft 1425. The shaft 1425 is coupled to the canards 1120. The motor 1415 can be operated to move the canards 1120 in a desired manner such as to achieve proportional actuation each canard 1120.

Figure 6A:
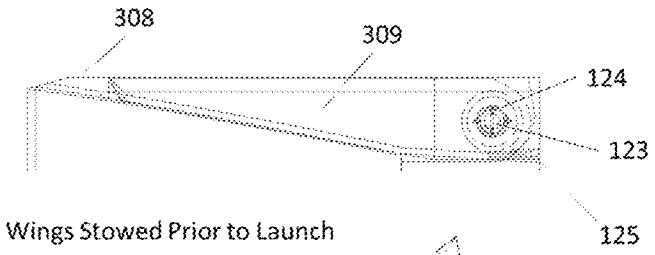
FIGS. 6A-6D show an example mechanism for extending the wings from a stowed configuration to an extended configuration.
Figure 6B:
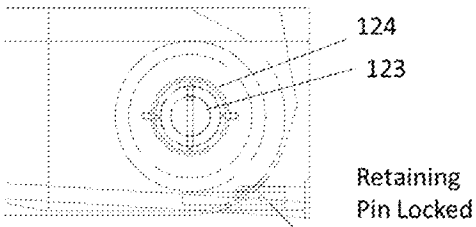
Figure 6C:
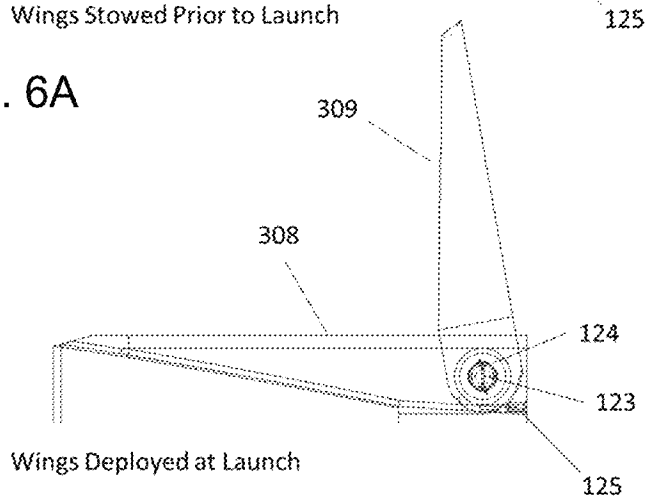
Figure 6D:
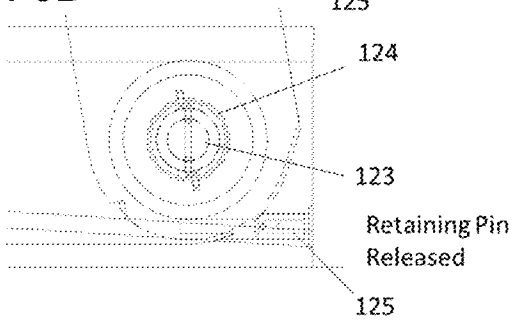

With reference still to FIGS. 6A and 6B, the motor 605 is positioned inside a bearing 1430 that is rigidly and fixedly attached to the housing 1105. That is, the bearing 1430 is attached to the housing 1105 in a manner such that any rotation of the housing 1105 is transferred to the bearing 1430. Thus, when the housing 1105 rotates, such as a result of loads experience during launch, the bearing also rotates along with the housing 1105. However, the motor 1430 does not necessarily rotate as the bearing 1430 prevents or reduces rotational movement and corresponding loads from being transferred to the motor 1430. The bearing arrangement thereby shields the motor 605 from loads on the housing 1105 during launch and ballistic movement. It has been observed that the ground-launched projectiles may experience loads on the order of 10,000 to 25,000 during launch. The configuration of the guidance unit advantageously protects the motor against such loads.

Guidance of Tail-Fin-Stabilized Projectile

As mentioned, the guidance unit 113 is configured to provide control over a TSP. In this regards, the guidance unit 113 controls a TSP using roll-to-turn guidance by differentially actuating the canards 1120 to achieve differential movement between one canard and another canard on the projectile 915. Such proportional actuation of the canards can be used to achieve a desired roll attitude while collectively actuating the canards to apply a pitching moment to achieve a desired angle of attack and lift. The cambered shape (FIG. 12) of the canard airfoil maximizes the achievable angle of attack. It has been shown that about 8 to 10 degrees of angle of attack yields maximum lift-to-draft ratio, which maximizes the projectile's glide ratio, thereby extending its range.

Guidance of Spin-Stabilized Projectile

Figure 15A:
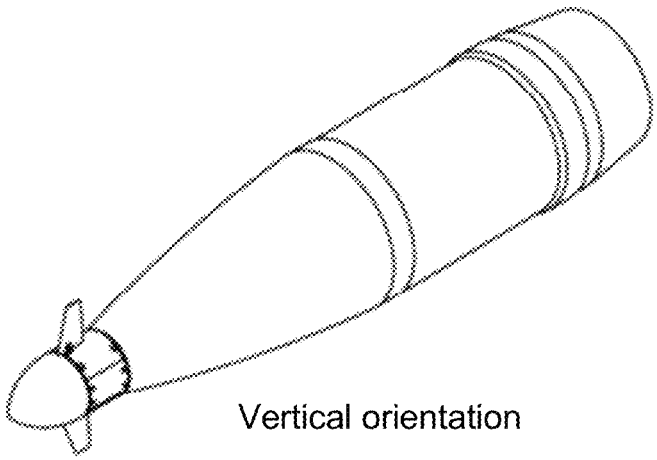
FIGS. 15A and 15B illustrates how a projectile may be guided by differential deflection of canards.
Figure 15B:
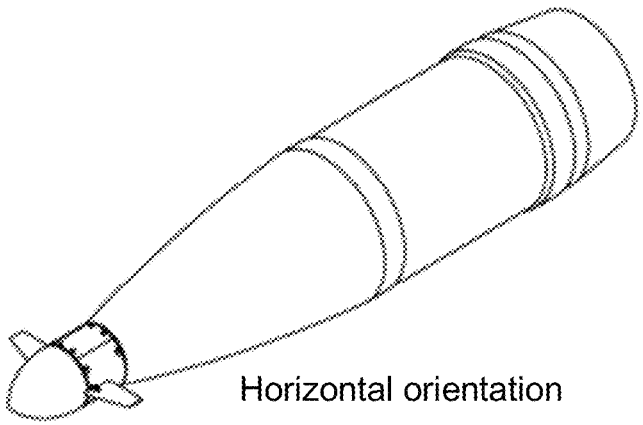

The guidance unit is further configured to provide control over a SSP. The physical hardware of the guidance unit for an SSP can be identical to that used for a TSP. As mentioned, the airfoil profile can also differ between the SSP and TSP. The guidance software used for the SSP guidance may also be configured differently. For guidance of an SSP, the guidance unit 113 is alternately oriented in a vertical and horizontal orientation, as shown in FIGS. 15A and 15B, by differential deflection of the canards. Once the guidance unit is established in one of a vertical or horizontal position, the motor 605 is operated to deflect the canards proportionally to apply the required amount of vertical or horizontal force to steer the projectile in such a manner as to continually keep it aligned along a pre-determined trajectory to the target. The amount of time spent in each of these orientations and the magnitude of the deflection during that period are determined in software according to the detected position and velocity deviations from the desired trajectory.

In use, the projectile 915 with guidance unit 113 is launched from a standard mortar tube. The guidance unit 113 controls its trajectory to the target according to guidance laws that assure optimum use of the available energy imparted at launch to reach maximum range and achieve steep-angle target engagement. It employs roll-to turn guidance to laterally steer to the target and to control the orientation of the unit relative to earth to optimize trajectory shaping in elevation During the ascent and ingress portion of the trajectory, the cambered canards are differentially deflected to establish and maintain the control unit in the upright position (roll angle=0). Collective deflection of the fins serves to cause the mortar bomb to assume an angle of attack corresponding to maximum lift-to-drag ratio, which translates into the flattest glide ratio (distance traveled to height lost) in order to maximally extend the range of the round.

This condition is maintained until the line of sight angle to the target approaches a pre-set target engagement dive angle, at which point the fins are once again differentially deflected to cause the control unit to invert (roll angle=180 degrees) and collectively deflected to cause the round to pitch down at the required angle to the target. Owing to the powerful control afforded by the high-lift cambered fins oriented in the inverted attitude, the pitch-down occurs very rapidly thereby minimizing the time and distance required to achieve the desired steep target engagement angle. Once the desired path angle is achieved, the canards roll the unit to the upright orientation and the round continues to fly to the target with the guidance unit in that attitude.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Although embodiments of various methods and devices are described herein in detail with reference to certain versions, it should be appreciated that other versions, embodiments, methods of use, and combinations thereof are also possible. Therefore the spirit and endoscope of the appended claims should not be limited to the description of the embodiments contained herein.

The invention claimed is:

1. A range extension unit for a guided mortar bomb, comprising:

a housing interface defining an internal cup that receives a rear portion of a guided mortar bomb, the housing interface covering the rear portion of the mortar bomb in the area between a start of an aft-sloping part of the mortar bomb and a root of a propulsion charge stem attachment point at the rear portion of the mortar bomb, such that the housing interface, when coupled to the mortar bomb, collectively forms an aerodynamically shaped body with the mortar bomb, and wherein the aft-sloping part of the mortar bomb starts at a maximum-diameter longitudinal mid-section of the mortar bomb and extends rearward toward a rear end of the mortar bomb;

at least two deployable wings attached to the housing interface, wherein the wings transition between a retracted state and a deployed state, wherein the range extension unit has no active propulsion system; and the guided mortar bomb coupled to the housing interface, wherein the guided mortar bomb and the coupled housing interface both fit entirely into a tubular mortar tube, the guided mortar bomb including a stem extending rearwardly out of the guided mortar bomb, the stem being an elongated cylindrical body, a majority of the stem being entirely enclosed by the housing interface.

2. The range extension unit of claim 1, wherein the housing interface includes a set of devises that house the deployable wings and that attach the deployable wings to the housing interface.

3. The range extension unit of claim 1, wherein the deployable wings increase a range and stability of the mortar bomb when the range extension unit is attached to the mortar bomb.

4. The range extension unit of claim 1, further comprising a spring-action mechanism that automatically transition the wings to the deployed state upon first motion of the mortar bomb from a launch device.

5. The range extension unit of claim 1, wherein range extension unit and the guided mortar bomb have a center of gravity that is closer to an aerodynamic center of the guided mortar bomb than when the range extension unit is not mounted on the guided mortar bomb.

6. The range extension unit of claim 1, wherein the stem extends rearwardly through the housing interface when the guided mortar bomb is received within the housing interface.

7. The range extension unit of claim 1, further comprising a guidance unit positionable on a front end of the mortar bomb.

8. The range extension unit of claim 7, wherein the guidance unit comprises:

a housing, the housing having a bullet-nosed region and an attachment region, wherein the attachment region inserts into the mortar bomb, wherein the bullet-nosed region of the housing rotates relative to the attachment region of the housing;

a motor contained within the housing;

a bearing surrounding the motor such that the motor is contained entirely within the bearing, the bearing being rigidly attached to the housing such that the motor rotates with the housing and shields the motor from inertial loads experienced by the housing, wherein the bearing rotates about an axis perpendicular to a long axis of the mortar bomb.

9. A method of extending a range of a mortar bomb, comprising:

providing a mortar bomb;

inserting a rear portion of a mortar bomb into a housing interface of a range extension unit to form a projectile, the housing interface defining an internal cup that receives the rear portion of a guided mortar bomb, and such that the housing interface covers the rear portion of the mortar bomb in the area between a start of an aft-sloping part of the mortar bomb and a root of a propulsion charge stem attachment point at the rear portion of the mortar bomb, and such that the housing interface, when coupled to the mortar bomb, collectively form an aerodynamically shaped body with the mortar bomb, wherein the range extension unit includes at least two deployable wings attached to the housing interface, and wherein the aft-sloping part of the mortar bomb starts at a maximum-diameter longitudinal mid-section of the mortar bomb and extends rearward toward a rear end of the mortar bomb, wherein the range extension unit has no active propulsion system, wherein the mortar bomb includes a stem extending rearwardly out of the mortar bomb, the stem being an elongated cylindrical body, a majority of the stem being entirely enclosed by the housing interface; and inserting the projectile into a mortar tube.

10. The method of claim 9, wherein the wings are located on a location of the mortar bomb that would otherwise not have wings were the range extension unit not attached to the mortar bomb.

* * * * *